US009257077B2

(12) United States Patent
Chang

(10) Patent No.: US 9,257,077 B2
(45) Date of Patent: Feb. 9, 2016

(54) LIQUID CRYSTAL DISPLAY APPARATUS AND DRIVING METHOD THEREOF

(71) Applicant: InnoLux Corporation, Miao-Li County (TW)

(72) Inventor: Shie-Ping Chang, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 239 days.

(21) Appl. No.: 14/030,319

(22) Filed: Sep. 18, 2013

(65) Prior Publication Data

US 2014/0085286 A1 Mar. 27, 2014

(30) Foreign Application Priority Data

Sep. 24, 2012 (TW) ..... 101134909 A

(51) Int. Cl.
*G09G 3/36* (2006.01)

(52) U.S. Cl.
CPC ..... *G09G 3/36* (2013.01); *G09G 3/3614* (2013.01); *G09G 3/3655* (2013.01); *G09G 3/3659* (2013.01); *G09G 3/3677* (2013.01)

(58) Field of Classification Search
CPC combination set(s) only.
See application file for complete search history.

(56) References Cited

U.S. PATENT DOCUMENTS

2012/0068991 A1 3/2012 Watsuda
2012/0274618 A1* 11/2012 Chen ..... 345/208

FOREIGN PATENT DOCUMENTS

CN 101349846 A 1/2009
CN 101546082 A 9/2009
CN 101546082 B * 9/2009
CN 101501561 B 4/2011

* cited by examiner

*Primary Examiner* — Kumar Patel
*Assistant Examiner* — Amy C Onyekaba
(74) *Attorney, Agent, or Firm* — Muncy, Geissler, Olds & Lowe, P.C.

(57) ABSTRACT

An LCD apparatus has a first scan line transmitting a first scan signal, a second scan line transmitting a second scan signal, a data line intersecting the first and second scan lines, a switch element electrically coupled to the first scan line and the data line, a pixel electrode electrically coupled to the switch element, a coupling capacitance electrically coupled to the pixel electrode and the second scan line. The second scan line has three different voltage levels. When the first scan line enables the switch element, the pixel electrode receives a data signal through the data line. When the second scan signal switches to the third voltage level from the second voltage level, the pixel electrode is negative polarity, and when the second scan signal switches to the second voltage level from the third voltage level, the pixel electrode is positive polarity.

10 Claims, 13 Drawing Sheets

+ + + + + +
+ − + − + −
− − − − − −
− + − + − +

FIG. 12A

− − − − − −
− + − + − +
+ + + + + +
+ − + − + −

FIG. 12B

LIQUID CRYSTAL DISPLAY APPARATUS AND DRIVING METHOD THEREOF

CROSS REFERENCE TO RELATED APPLICATIONS

This Non-provisional application claims priority under 35 U.S.C. §119(a) on Patent Application No(s). 101134909 filed in Taiwan, Republic of China on Sep. 24, 2012, the entire contents of which are hereby incorporated by reference.

BACKGROUND

1. Technical Field

The disclosed embodiments relate to a liquid crystal display (LCD) apparatus and a driving method thereof and, in particular, to an active matrix LCD apparatus and a driving method thereof.

2. Related Art

With the progress of technologies, display apparatuses have been widely applied to various fields. Especially for liquid crystal display (LCD) apparatuses, because of having advantages such as low power consumption, less heat, light weight and less radiation, they are gradually taking the place of cathode ray tube (CRT) display apparatuses and widely applied to various electronic products. For example, LCD apparatuses of an in-plane switch (IPS) type or a fringe field switching (FFS) type are commonly used to portable electronic products, such as smart phones, tablet computers, PDAs, digital cameras or notebooks. Besides, with the improvement of microprocessors, portable products are configured with more enhanced functions, but at the same time, the power consumption thereof is also increased a lot.

FIG. 1A is a schematic diagram of two adjacent pixels PA and PB of a conventional LCD apparatus, and FIG. 1B is a schematic diagram of the signals driving the pixels PA and PB in FIG. 1A.

In FIG. 1A, the coupling capacitance $C_{C1}$ is electrically coupled to the pixel electrode $V_A$ and the scan line G2, and the coupling capacitance $C_{C2}$ is electrically coupled to the pixel electrode $V_B$ and the scan line G1. In FIG. 1B, the scan signals (still denoted by G2 and G3) of the scan lines G2 and G3 have two voltage levels, such as 22V of a high voltage level $V_{GH}$ and −7V of a low voltage level $V_{GL}$. During the period T1, the scan signals G3 and G2 respectively enable (turn on) the switch elements $S_A$ and $S_B$, and thus the data signals (voltage level of 0.5V for example) are respectively inputted to the pixel electrodes $V_A$ and $V_B$, so that the pixel electrodes $V_A$ and $V_B$ respectively have voltages of 0.5V. During the period T2, the scan signal G3 disables (turns off) the switch element $S_A$ while the scan signal G2 continuously enables the switch element $S_B$, and meanwhile the data signal (voltage signal of 6.5V for example) is inputted to the pixel electrode $V_B$, so that the pixel electrode $V_B$ has voltage of 6.5V.

The scan signal G3 down to −7V from 22V at the time t2 will cause a feedthrough effect to the pixel electrode $V_A$, and meanwhile the capacitive coupling effect is caused by the parasitic capacitance between the drain and source of the switch element $S_A$. Therefore, the pixel electrode $V_A$ will go down to, for example, −0.5V from 0.5V (i.e. a 1V drop) for the first time. Besides, when the scan signal G2 goes down to −7V from 22V at the time t3, another capacitive coupling effect will be caused to the pixel electrode $V_A$ by the coupling capacitance $C_{C1}$, making the pixel electrode $V_A$ go down to, for example, −5.5V from −0.5V (i.e. a 5V drop). In other words, only by applying 0.5V to the data line Data, the pixel electrode $V_A$ can achieve −5.5V for the negative polarity operation of the pixel PA. Thereby, compared with the negative polarity operation of the pixel in the conventional art, the data line here has a smaller voltage swing (i.e. smaller difference of the highest and lowest voltage levels) so that the power saving can be achieved.

However, for the pixel PB, because the scan of the scan line G1 electrically coupled to the coupling capacitance $C_{C2}$ needs to finish before the scan of the scan line G2, the pixel electrode $V_B$ that has been charged to 6.5V at the time t3 is just affected by the feedthrough effect induced by the transition from a high voltage level to a low voltage level of the scan line G2, so as to go down to 5.5V (i.e. 1V drop), and meanwhile the pixel PB is on the positive polarity operation.

Therefore, it is an important subject to provide a liquid crystal display apparatus and a driving method thereof wherein the swing of the operating voltages of positive and negative polarities of the data line can be reduced for decreasing the power consumption of the data driving circuit and thus achieving the power saving.

SUMMARY

In view of the foregoing subject, an objective of this disclosure is to provide a liquid crystal display apparatus and a driving method thereof wherein the swing of the operating voltages of positive and negative polarities of the data line can be reduced for decreasing the power consumption of the data driving circuit and thus achieving the power saving.

To achieve the above objective, a liquid crystal display apparatus according to the embodiments of this disclosure has at least one pixel, which comprises a first scan line transmitting a first scan signal, a second scan line transmitting a second scan signal, a data line intersecting the first and second scan lines, a switch element electrically coupled to the first scan line and the data line, a pixel electrode electrically coupled to the switch element, and a coupling capacitance electrically coupled to the pixel electrode and the second scan line. When the first scan line enables the switch element, the pixel electrode receives a data signal through the data line. The second scan signal has a first voltage level, a second voltage level and a third voltage level, which are different from one another during a frame time. When the second scan signal switches to the third voltage level from the second voltage level, the pixel electrode is negative polarity, and when the second scan signal switches to the second voltage level from the third voltage level, the pixel electrode is positive polarity.

To achieve the above objective, a driving method of a liquid crystal display apparatus is disclosed according to the embodiments of this disclosure. The LCD apparatus includes at least one pixel having a first scan line, a second scan line, a data line, a switch element and a pixel electrode, wherein the data line intersects the first and second scan lines, the switch element is electrically coupled to the first scan line and the data line, the pixel electrode is electrically coupled to the switch element, and the coupling capacitance is electrically coupled to the pixel electrode and the second scan line. The driving method comprises the steps of: transmitting a first scan signal by the first scan line to enable the switch element during a frame time, so that the pixel electrode receives a data signal transmitted by the data line; transmitting a second scan signal by the second scan line to the coupling capacitance during the frame time, wherein the second scan signal includes a first voltage level, a second voltage level and a third voltage level, which are different from one another during the frame time; the voltage level of the pixel electrode being negative polarity when the second scan signal switches to the third voltage level from the second voltage level; and the voltage level of the pixel electrode being positive polarity when the second scan signal switches to the second voltage level from the third voltage level.

As mentioned above, in the LCD apparatus according to the embodiments of this disclosure, the scan signal have three different voltage levels to drive the pixels. Thereby, only the less swing of the operating voltages of the data line is needed to make the pixel have larger voltage levels of positive and negative polarities which are required for the pixel's operation. Therefore, in this disclosure, the swing of the operating voltages of positive and negative polarities of the data line can be reduced, so that the power consumption of the data driving circuit is decreased and thus the power saving is achieved.

BRIEF DESCRIPTION OF THE DRAWINGS

The invention will become more fully understood from the detailed description and accompanying drawings, which are given for illustration only, and thus are not limitative of the present invention, and wherein:

FIGS. 12A and 12B are schematic diagrams respectively showing the polarity inversions of the pixel of the LCD apparatus during the first and second frame times, respectively, according to an embodiment of this disclosure.

DETAILED DESCRIPTION

The present invention will be apparent from the following detailed description, which proceeds with reference to the accompanying drawings, wherein the same references relate to the same elements.

The liquid crystal display (LCD) apparatus of this disclosure can be of an in-plane switch (IPS) type, a fringe field switching (FFS) type, or other types.

Figure 1A:
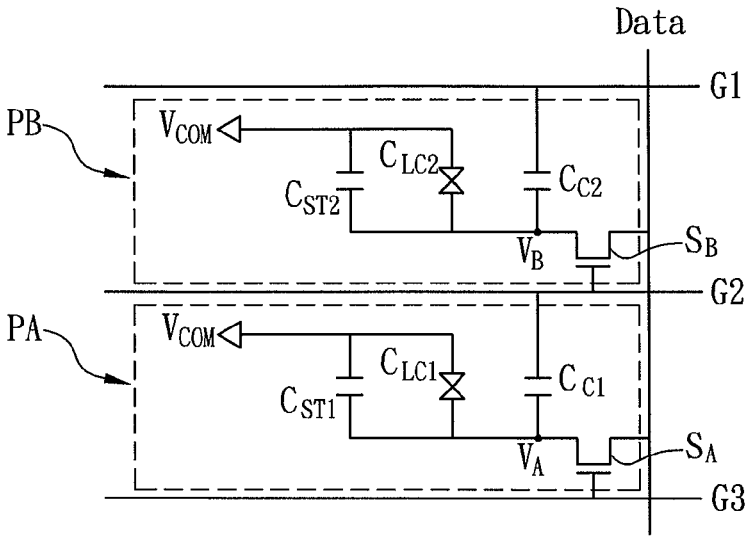
FIG. 1A (Prior Art)
FIG. 1A is a schematic diagram of two adjacent pixels of a conventional LCD apparatus.
Figure 1B:
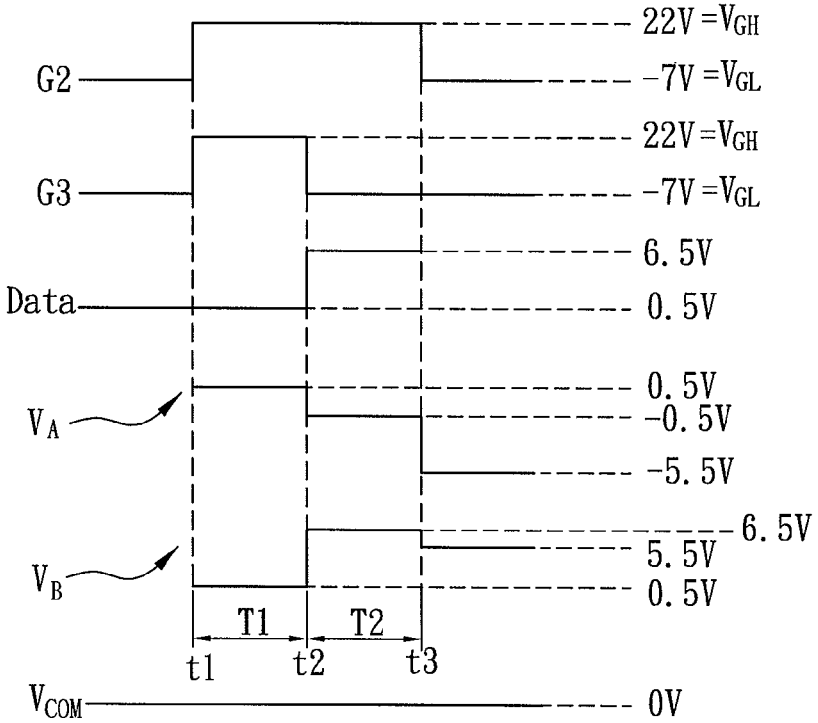
FIG. 1B (Prior Art)
FIG. 1B is a schematic diagram of the signals driving the pixels in FIG. 1A
Figure 2:
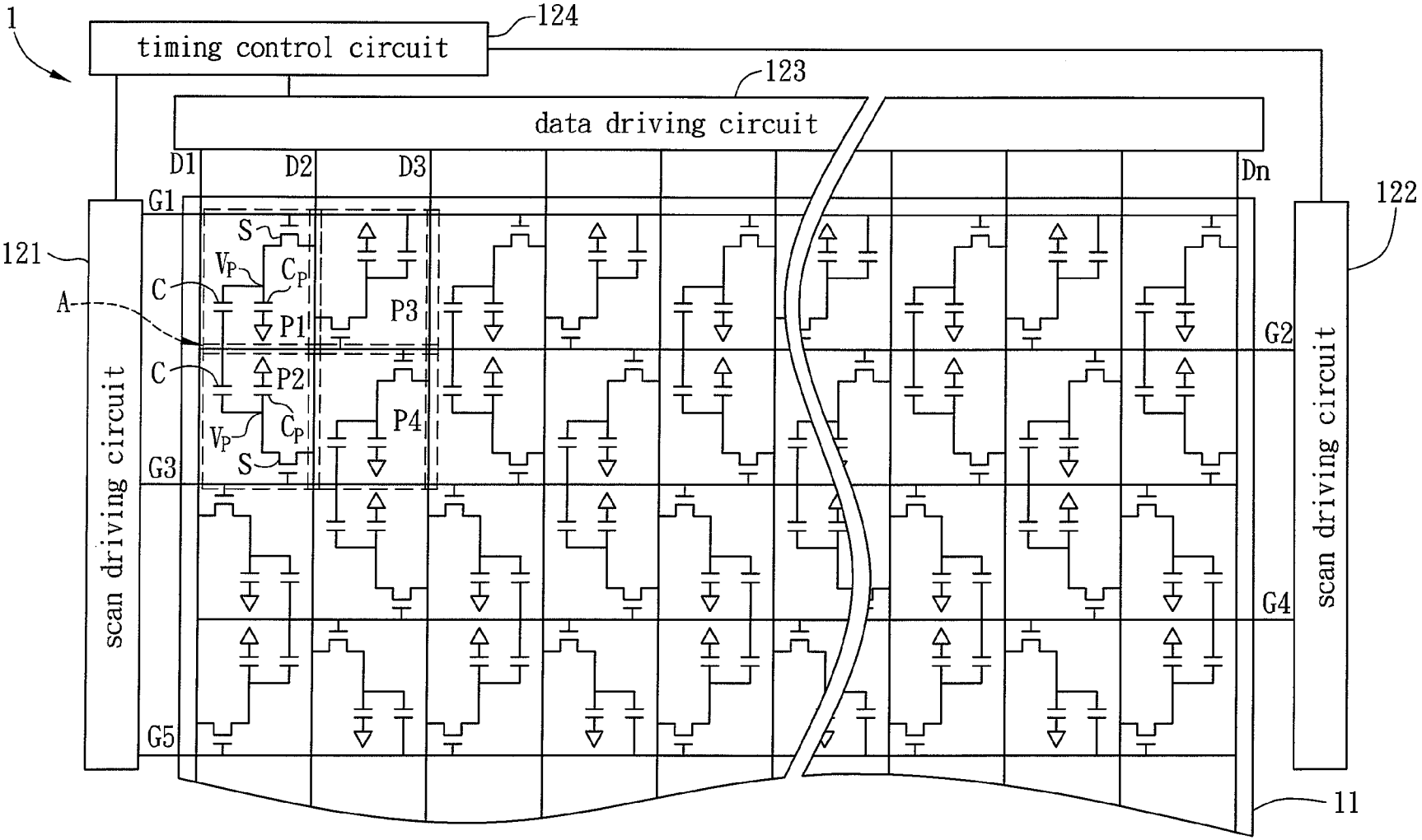
FIG. 2 is a schematic diagram of an LCD apparatus according to an embodiment of this disclosure.

FIG. 2 is a schematic diagram of an LCD apparatus 1 according to an embodiment of this disclosure.

In FIG. 2, the LCD apparatus 1 includes a display panel 11 and a driving module. The driving module includes two scan driving circuits 121 and 122, a data driving circuit 123 and a timing control circuit 124.

The display panel 11 has at least one pixel, and the driving module drives the display panel 11 by at least a scan line and at least a data line. In this embodiment, the LCD apparatus 1 is instanced as having a plurality of pixels, a plurality of scan lines G1~Gm (not shown) and a plurality of data lines D1~Dn. The scan lines and the data lines intersect each other to form the pixel array. The display panel 11 is electrically connected to the driving module through the scan lines and the data lines. As an embodiment, the pixels can include red pixels, green pixels and blue pixels. To be noted, in the figures of this disclosure, the intersection of the scan line and data line is not denoted in a jump-line way to show they are not connected to each other, but it is also not denoted by a dot to show they are connected to each other. In fact, those skilled in the art should know that the data line and the scan line (such as the data line D1 and the scan line G1) are not connected to each other even though they intersect each other.

In this embodiment, the scan driving circuits 121 and 122 are respectively disposed on the opposite sides of the display panel. The scan driving circuit 121 is electrically coupled to the display panel 11 through the odd scan lines (e.g. G1, G3, . . . ), and the scan driving circuit 122 is electrically coupled to the display panel 11 through the even scan lines (e.g. G2, G4, . . . ). The data driving circuit 123 is electrically coupled to the display panel through the data lines. In other embodiments, a single scan driving circuit can be disposed on a side of the display panel 11.

The timing control circuit 124 is electrically coupled to the scan driving circuits 121 and 122 and the data driving circuit 123. The timing control circuit 124 can transmit the vertical clock signal and the vertical synchronizing signal to the scan driving circuits 121 and 122, convert the video signal received from outside into the data signal for the data driving circuit 123, and transmit the data signal, horizontal clock signal and horizontal synchronizing signal to the data driving circuit 123. Besides, the scan driving circuits 121 and 122 enable the scan lines sequentially, according to the vertical clock signal and the vertical synchronizing signal. When the scan lines are enabled sequentially, the data driving circuit 123 transmits the data signal (voltage signal) corresponding to the pixels of each row through the data lines for displaying images.

The pixel structure is illustrated as below by the pixels P1 and P2 in FIG. 2.

The pixel P1 includes a first scan line, a second scan line, a data line, a switch element S, a pixel electrode $V_P$, a capacitance $C_P$ and a coupling capacitance C.

The first scan line can transmit a first scan signal, and the second scan line can transmit a second scan signal. In this embodiment as an example, each of the first and second scan signals can have three different voltage levels, i.e. a first voltage level $V_{GH}$, a second voltage level $V_{GM}$ and a third voltage level $V_{GL}$, during a frame time. The first voltage level $V_{GH}$ is higher than the second voltage level $V_{GM}$, and the second voltage level $V_{GM}$ is higher than the third voltage level $V_{GL}$. In the following illustration, the first voltage level $V_{GH}$ is 15V, the second voltage level $V_{GM}$ is 0V, and the third voltage level $V_{GL}$ is −10V, for example. Besides, in the pixel P1, the first scan line is the scan line G1 and the second scan line is the scan line G2.

The data line intersects the first and second scan lines. In the pixel P1, the data line is the data line D2, which is connected to the pixel P1.

The switch element S is electrically coupled to the first scan line and the data line. In this embodiment, the switch element S is electrically connected to the scan line G1 and the data line D2.

The pixel electrode $V_P$ is electrically coupled to the switch element S. Herein, the gate of the switch element S is electrically coupled to the scan line G1, the source of that is electrically coupled to the data line D2, and the drain of that is electrically coupled to the pixel electrode $V_P$. When the first scan line (scan line G1) enables the switch element S, the pixel electrode $V_P$ can receive a data signal transmitted by the data driving circuit 123 through the data line (data line D2) so that the pixel P1 can display the corresponding gray level.

The coupling capacitance C is electrically coupled to the pixel electrode $V_P$ and the second scan line. Herein, the coupling capacitance C is electrically coupled to the pixel electrode $V_P$ and the scan line G2. The pixel P1 can further include a capacitance $C_P$, which is electrically coupled to the pixel electrode $V_P$ and a common electrode Vcom (denoted by a symbol "∇"). Herein, the common electrode Vcom is a direct current (DC) bias for example. Besides, in FIG. 2, the capacitance $C_P$ can represent the liquid crystal capacitance and storage capacitance of the pixel.

The pixel P2 includes a first scan line, a second scan line, a data line, a switch element S, a pixel electrode $V_P$, a capacitance $C_P$ and a coupling capacitance C.

The first scan line can transmit a first scan signal, and the second scan line can transmit a second scan signal. Like the pixel P1, each of the first and second scan signals can have three different voltage levels, i.e. a first voltage level $V_{GH}$, a second voltage level $V_{GM}$ and a third voltage level $V_{GL}$, during a frame time. The first voltage level $V_{GH}$ is higher than the second voltage level $V_{GM}$, and the second voltage level $V_{GM}$ is higher than the third voltage level $V_{GL}$. In the pixel P2, the first scan line is the scan line G3 and the second scan line is the scan line G2.

The data line intersects the first and second scan lines. In the pixel P2, the data line is the data line D2.

The switch element S is electrically coupled to the first scan line and the data line. In this embodiment, the switch element S is electrically connected to the scan line G3 and the data line D2.

The pixel electrode $V_P$ is electrically coupled to the switch element S. Herein, the gate of the switch element S is electrically coupled to the scan line G3, the source of that is electrically coupled to the data line D2, and the drain of that is electrically coupled to the pixel electrode $V_P$. When the first scan line (scan line G3) enables the switch element S, the pixel electrode $V_P$ can receive a data signal transmitted by the data driving circuit 123 through the data line (data line D2) so that the pixel P2 can display the corresponding gray level.

The coupling capacitance C is electrically coupled to the pixel electrode $V_P$ and the second scan line. Herein, the coupling capacitance C is electrically coupled to the pixel electrode $V_P$ and the scan line G2. The pixel P1 can further include a capacitance $C_P$, which is electrically coupled to the pixel electrode $V_P$ and a common electrode Vcom.

To be noted, the first scan line of this embodiment is not necessarily the scan line G1 and the second scan line is not necessarily the scan line G2. The first scan line and the second scan line are determined by the scan line electrically connected to the switch element S of the target pixel and the scan line electrically connected to the coupling capacitance of the target pixel. In other words, the scan line controlling whether the switch element S of the pixel is enabled is called the first scan line, and the scan line electrically connected to the coupling capacitance C in the pixel is called the second scan line. Besides, the above-mentioned data line doesn't mean a certain data line exclusively, but means the data line electrically coupled to the switch element S in the pixel. Accordingly, the pixels P1 and P2 can partially overlap each other, and for example, the scan line G2 can be included by the pixel P1 and the pixel P2 while the data line D2 can be included by the pixel P1 and the pixel P3, and the rest can be deduced by analogy.

The switch element S can include a metal oxide thin film transistor (MOTFT), such as an indium gallium zinc oxide TFT (IGZO-TFT). The MOTFT is characterized by low leakage current (between $10^{-14}$ A and $10^{-18}$ A), high electronic bandgap (about 3.1 eV) and low sensitivity to the light. Because the leakage current is very small, the voltage of the pixel electrode is easy to be kept when more negative bias is applied to the gate, and also the vertical crosstalk can be prevented. Besides, since the IGZO-TFT has a threshold voltage $V_{th}$ larger than zero, functioning as an enhancement mode TFT, it is turned off when the gate voltage is 0V. Accordingly, the first voltage level $V_{GH}$ (such as 15V, and $V_{GH}$ is the largest turn-on voltage of the switch element S) can enable the switch element S, and the second voltage level $V_{GM}$ (such as 0V) and the third voltage level (such as −10V) can disable (turn off) the switch element S.

Figure 3A:
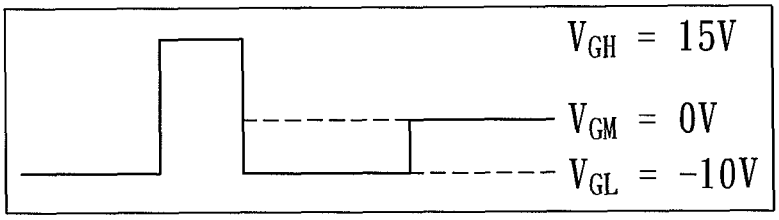
FIGS. 3A and 3B are schematic diagrams of the scan signal waveforms according to embodiments of this disclosure.
Figure 3B:
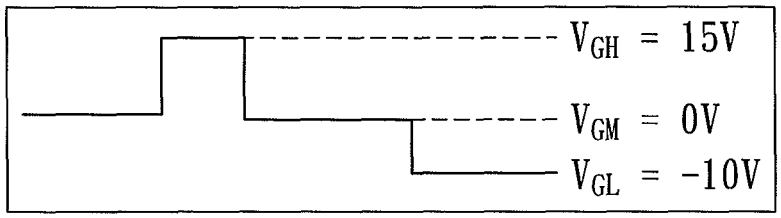

Besides, two waveforms of the scan signal are applied to the following embodiments. The first kind is shown in FIG. 3A, and the second kind is shown in FIG. 3B. In FIG. 3A, the scan signal switches to the first voltage level $V_{GH}$ from the third voltage level $V_{GL}$, then switches to the third voltage level $V_{GL}$ from the first voltage level $V_{GH}$, and then switches to the second voltage level $V_{GM}$ from the third voltage level $V_{GL}$. In FIG. 3B, the scan signal switches to the first voltage level $V_{GH}$ from the second voltage level $V_{GM}$, then switches to the second voltage level $V_{GM}$ from the first voltage level $V_{GH}$, and then switches to the third voltage level $V_{GL}$ from the second voltage level $V_{GM}$.

The driving process of a pixel unit A including the pixels P1 to P4 in FIG. 2 is illustrated as below, and those skilled in the art can thus know the whole driving of the LCD apparatus 1.

The driving process of the pixel unit A for two consecutive frame times (i.e. the first frame time and the second frame time) are illustrated by referring to FIGS. 4A to 11B. Herein, the data driving circuit 123 of the LCD apparatus 1 outputs signals according to the column inversion mode.

Figure 4A:
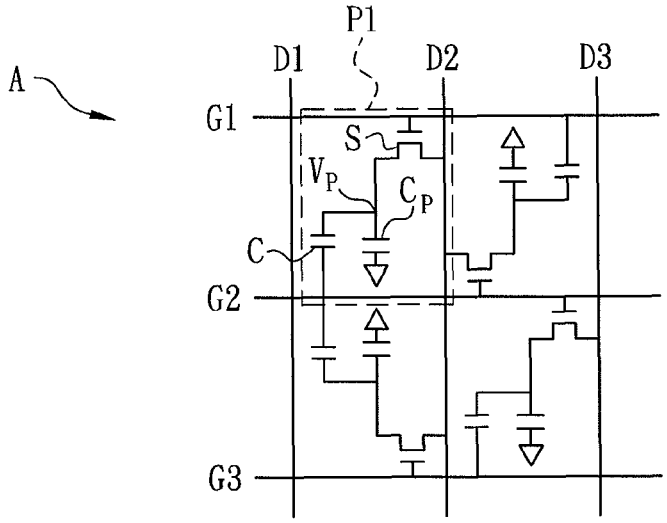
FIGS. 4A, 5A, 6A, 7A, 8A, 9A, 10A and 11A are schematic diagrams of the pixel unit in FIG. 2.
Figure 4B:
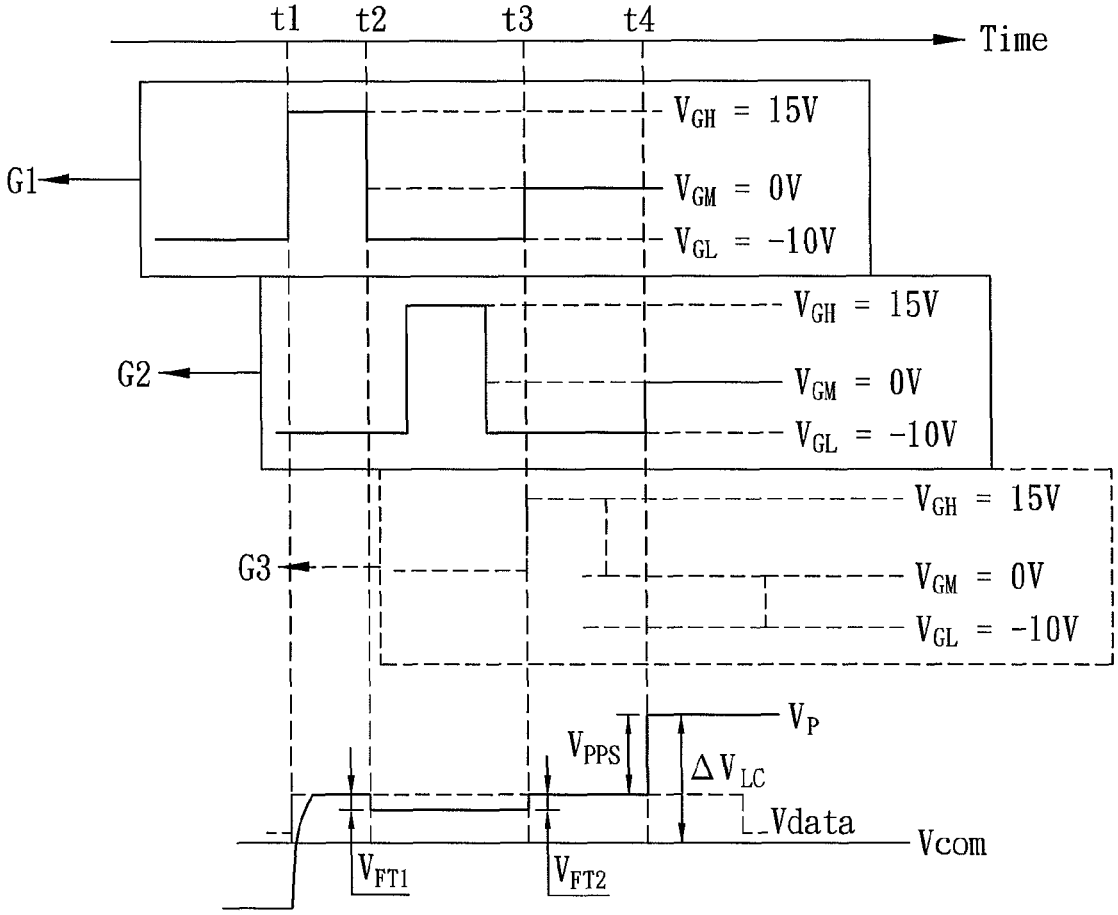
FIGS. 4B, 5B, 6B, 7B, 8B, 9B, 10B and 11B are schematic diagrams of the signal waveforms of the pixel of the pixel unit in FIGS. 4A~11A, respectively, during the first or second frame time.

FIG. 4A is a schematic diagram of the pixel unit A in FIG. 2, and FIG. 4B is a schematic diagram of the signal waveforms of the pixel P1 of the pixel unit A in FIG. 4A during the first frame time.

During the first frame time, each of the first scan line (scan line G1) and the second scan line (scan line G2) switches to the first voltage level $V_{GH}$ from the third voltage level $V_{GL}$, then switches to the third voltage level $V_{GL}$, and then switches to the second voltage level $V_{GM}$ from the third voltage level $V_{GL}$. Accordingly, during the period from the time t1 to the time t2, since the switch element S is enabled by the first voltage level $V_{GH}$ of the first scan line (scan line G1), the voltage (denoted by Vdata) of the data line D2 is inputted to the pixel electrode $V_P$, so that the pixel voltage $V_P$ has the same voltage level as the data line D2 ($V_P$=Vdata). Here, the data line D2 is on the operation of positive polarity.

At the time t2, the first feedthrough effect is caused to the pixel electrode $V_P$ because the scan line G1 (first scan line) goes down to the third voltage level $V_{GL}$ from the first voltage level $V_{GH}$, and meanwhile, the inner charges will be redistributed by the principle of charge conservation, and also the capacitive coupling effect is caused by the gate-drain parasitic capacitance ($C_{GD}$) of the switch element S of the pixel P1. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GL}-V_{GH})$, $V_{FT1}<0$, wherein $C_{GD}$ is the parasitic capacitance of the switch element S, $C_P$ is the capacitance (LC capacitance and storage capacitance) formed between the pixel electrode $V_P$ and the common electrode Vcom, and C is the coupling capacitance formed between the pixel electrode $V_P$ and the scan line G2.

At the time t3, the second feedthrough effect is caused to the pixel electrode $V_P$ because the scan line G1 (first scan line) goes up to the second voltage level $V_{GM}$ from the third voltage level $V_{GL}$, and meanwhile the capacitive coupling effect is caused by the gate-drain parasitic capacitance ($C_{GD}$) of the switch element S of the pixel P1. Therefore, the pixel electrode $V_P$ generates the second variation in voltage level (lift by $V_{FT2}$), and the voltage difference $V_{FT2}$ is represented by the equation: $V_{FT2}=C_{GD}/(C_{GD}+C_P+C)\times(V_{GM}-V_{GL})$, $V_{FT2}>0$. To deserve to be mentioned, although the scan line G2 (second scan line) goes up to the first voltage level $V_{GH}$ from the third voltage level $V_{GL}$ and goes down to the third voltage level $V_{GL}$ from the first voltage level $V_{GH}$ during the period from the time t2 to the time t3, the total feedthrough effects (a positive and a negative) thus caused just offset each other, so that the voltage level of the pixel electrode $V_P$ will not be affected.

At the time t4, the third feedthrough effect is caused to the pixel electrode $V_P$ because the scan line G2 (second scan line) goes up to the second voltage level $V_{GM}$ from the third voltage level $V_{GL}$, and meanwhile, the inner charges will be redistributed by the principle of charge conservation, and also the capacitive coupling effect is caused by the coupling capacitance C. Therefore, the pixel electrode $V_P$ generates the third variation in voltage level (lift by $V_{PPS}$, "PPS" here means pixel potential shift on gate), and the voltage difference $V_{PPS}$ is represented by the equation: $V_{PPS}=C/(C_{GD}+C_P+C)\times(V_{GM}-V_{GL})$, $V_{PPS}>0$, wherein the amount of the coupling capacitance C can be designed according to the requirements of images displayed by the pixels of the display panel 11. Therefore, since the electrode pixel $V_P$ is in conformity with the equation: $V_P=Vdata+V_{FT1}+V_{FT2}+V_{PPS}$, the voltage difference $\Delta V_{LC}$ ($=V_P-Vcom$) between the pixel electrode and the common electrode is larger than zero, so that the pixel electrode $V_P$ is positive polarity.

Figure 5A:
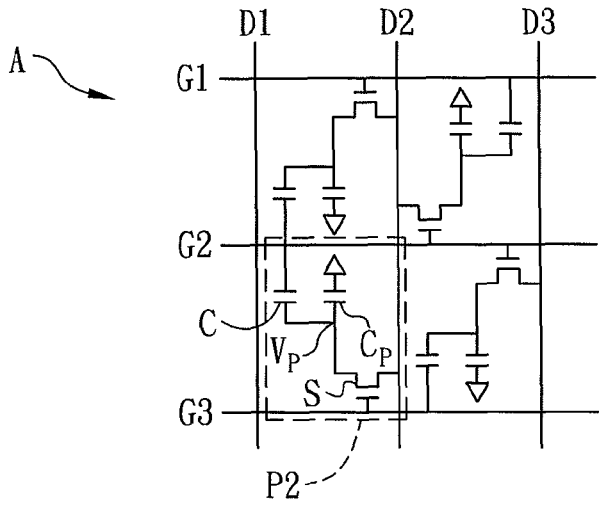
Figure 5B:
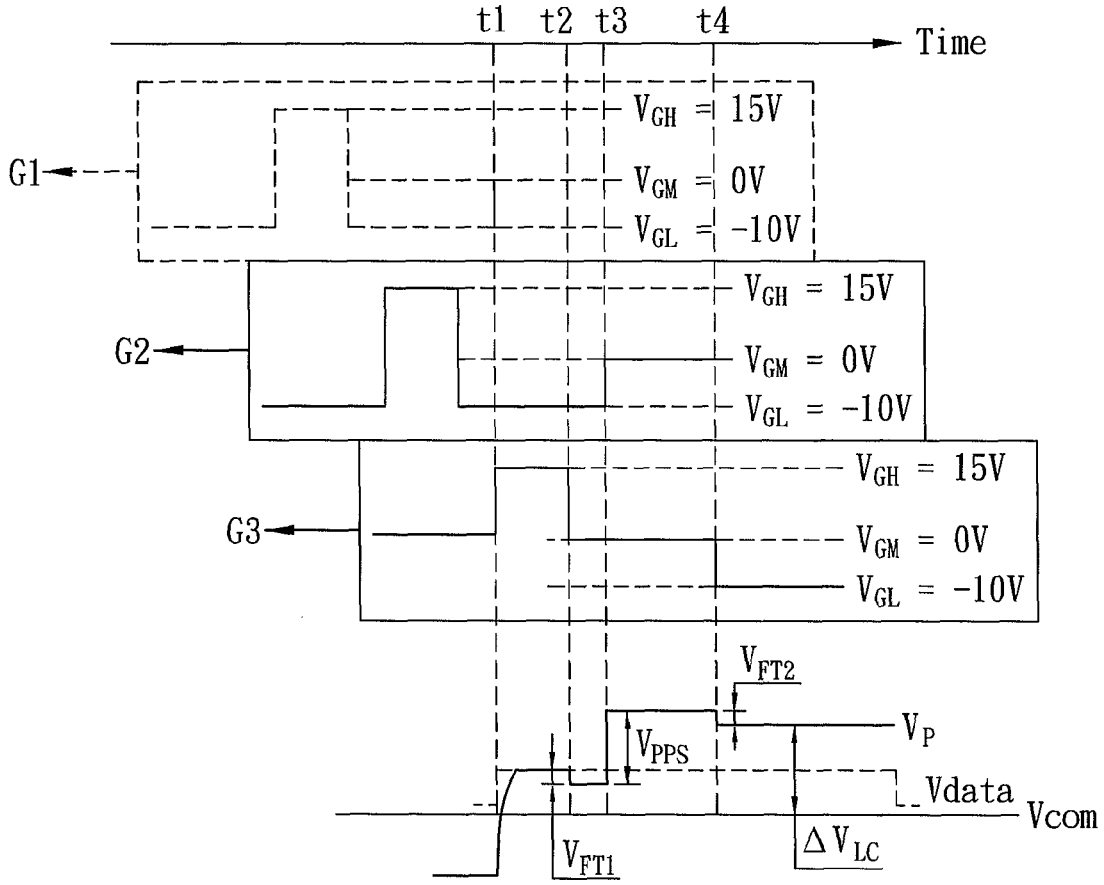

FIG. 5A is a schematic diagram of the pixel unit A in FIG. 2, and FIG. 5B is a schematic diagram of signal waveforms of the pixel P2 of the pixel unit A in FIG. 5A during the first frame time.

During the first frame time, the first scan line (scan line G3) switches to the first voltage level $V_{GH}$ from the second voltage level $V_{GM}$, then switches to the second voltage level $V_{GM}$, and then switches to the third voltage level $V_{GL}$ from the second voltage level $V_{GM}$. Meanwhile, the second scan line (scan line G2) switches to the first voltage level $V_{GH}$ from the third voltage level $V_{GL}$, then switches to the third voltage level $V_{GL}$, and then switches to the second voltage level $V_{GM}$ from the third voltage level $V_{GL}$. Accordingly, during the period from the time t1 to the time t2, since the switch element S is enabled by the first voltage level $V_{GH}$ of the first scan line (scan line G3), the voltage of the data line D2 is inputted to the pixel electrode $V_P$, so that the pixel voltage $V_P$ has the same voltage level as the data line D2 ($V_P=Vdata$). Here, the data line D2 is on the operation of positive polarity.

At the time t2, the first feedthrough effect is caused to the pixel electrode $V_P$ because the scan line G3 (first scan line) goes down to the second voltage level $V_{GM}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GM}-V_{GH})$, $V_{FT1}<0$.

At the time t3, the second feedthrough effect is caused to the pixel electrode $V_P$ because the scan line G2 (second scan line) goes up to the second voltage level $V_{GM}$ from the third voltage level $V_{GL}$, and meanwhile the capacitive coupling effect is caused by the coupling capacitance C. Therefore, the pixel electrode $V_P$ generates the second variation in voltage level (lift by $V_{PPS}$), and the voltage difference $V_{PPS}$ is represented by the equation: $V_{PPS}=C/(C_{GD}+C_P+C)\times(V_{GM}-V_{GL})$, $_{PPS}>0$.

At the time t4, the third feedthrough effect is caused to the pixel electrode $V_P$ because the scan line G3 (first scan line) goes down to the third voltage level $V_{GL}$ from the second voltage level $V_{GM}$. Therefore, the pixel electrode $V_P$ generates the third variation in voltage level (drop by $V_{FT2}$), and the voltage difference $V_{FT2}$ is represented by the equation: $V_{FT2}=C_{GD}/(C_{GD}+C_P+C)\times(V_{GL}-V_{GM})$, $V_{FT2}<0$. Therefore, since the electrode pixel $V_P$ is in conformity with the equation: $V_P=Vdata+V_{FT1}+V_{PPS}+V_{FT2}$, the voltage difference $\Delta V_{LC}$ ($=V_P-Vcom$) between the pixel electrode and the common electrode is larger than zero, so that the pixel electrode $V_P$ is also positive polarity.

Figure 6A:
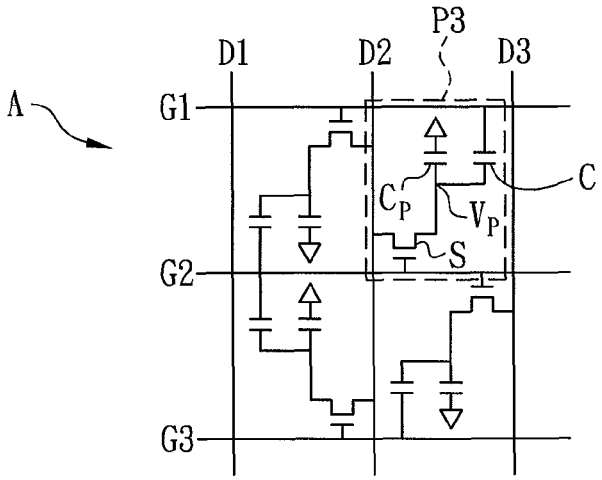
Figure 6B:
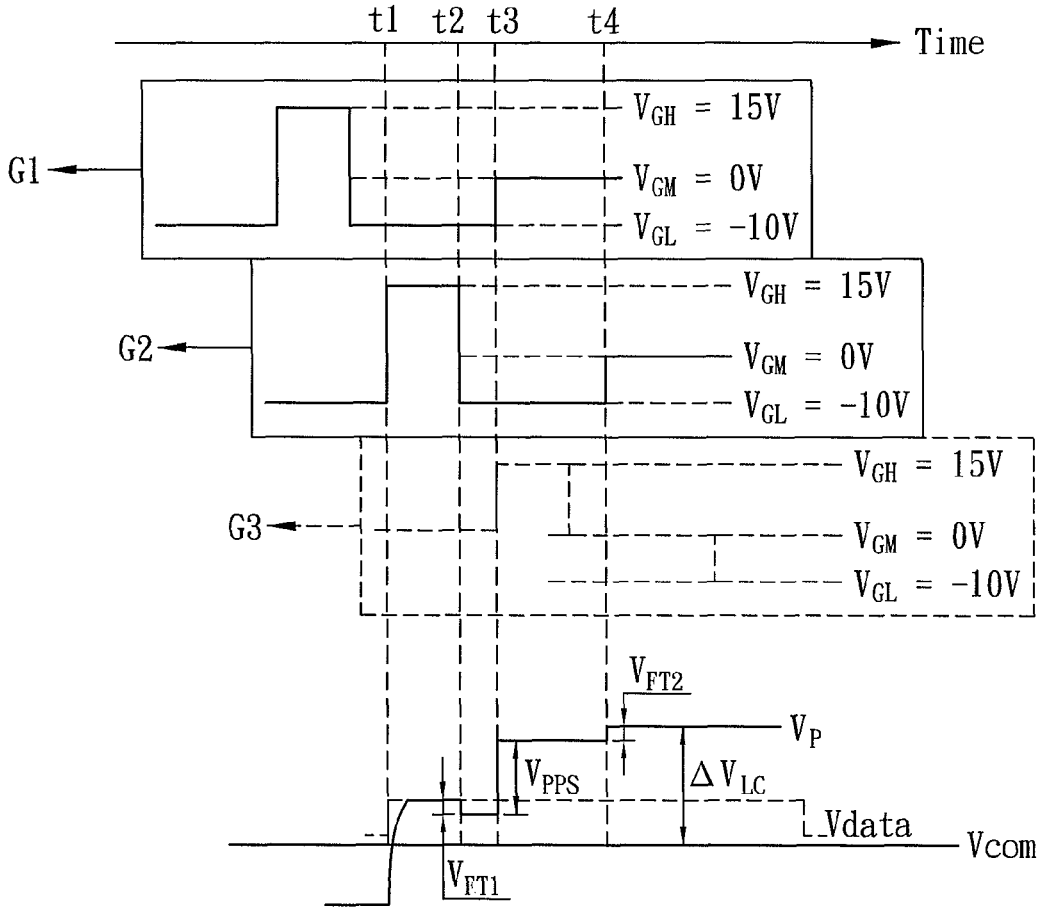

FIG. 6A is a schematic diagram of the pixel unit A in FIG. 2, and FIG. 6B is a schematic diagram of signal waveforms of the pixel P3 of the pixel unit A in FIG. 6A during the first frame time.

During the first frame time, each of the first scan line (scan line G2) and the second scan line (scan line G1) switches to the first voltage level $V_{GH}$ from the third voltage level $V_{GL}$, then switches to the third voltage level $V_{GL}$, and then switches to the second voltage level $V_{GM}$ from the third voltage level $V_{GL}$. Accordingly, during the period from the time t1 to the time t2, since the switch element S is enabled by the first voltage level $V_{GH}$ of the first scan line (scan line G2), the voltage of the data line D2 is inputted to the pixel electrode $V_P$, so that the pixel voltage $V_P$ has the same voltage level as the data line D2 ($V_P=Vdata$). Here, the data line D2 is on the operation of positive polarity.

At the time t2, the first feedthrough effect is caused to the pixel electrode $V_P$ because the scan line G2 (first scan line) goes down to the third voltage level $V_{GL}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GL}-V_{GH})$, $V_{FT1}<0$.

At the time t3, the second feedthrough effect is caused to the pixel electrode $V_P$ because the scan line G1 (second scan line) goes up to the second voltage level $V_{GM}$ from the third voltage level $V_{GL}$, and meanwhile the capacitive coupling effect is caused by the coupling capacitance C. Therefore, the pixel electrode $V_P$ generates the second variation in voltage level (lift by $V_{PPS}$), and the voltage difference $V_{PPS}$ is represented by the equation: $V_{PPS}=C/(C_{GD}+C_P+C)\times(V_{GM}-V_{GL})$, $V_{PPS}>0$.

At the time t4, the third feedthrough effect is caused to the pixel electrode $V_P$ because the scan line G2 (first scan line) goes up to the second voltage level $V_{GM}$ from the third voltage level $V_{GL}$. Therefore, the pixel electrode $V_P$ generates the third variation in voltage level (drop by $V_{FT2}$), and the voltage difference $V_{FT2}$ is represented by the equation: $V_{FT2}=C_{GD}/(C_{GD}+C_P+C)\times(V_{GM}-V_{GL})$, $V_{FT2}>0$. Therefore, since the electrode pixel $V_P$ is in conformity with the equation: $V_P=Vdata+V_{FT1}+V_{PPS}+V_{FT2}$, the voltage difference $\Delta V_{LC}$ ($=V_P-Vcom$) between the pixel electrode and the common electrode is larger than zero, so that the pixel electrode $V_P$ is also positive polarity.

Figure 7A:
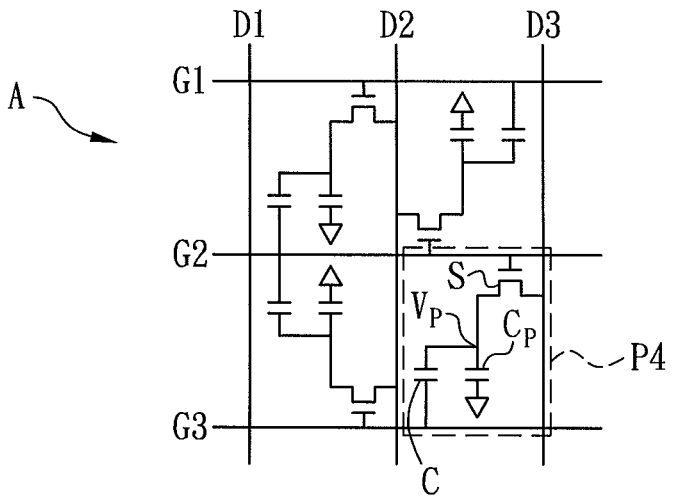
Figure 7B:
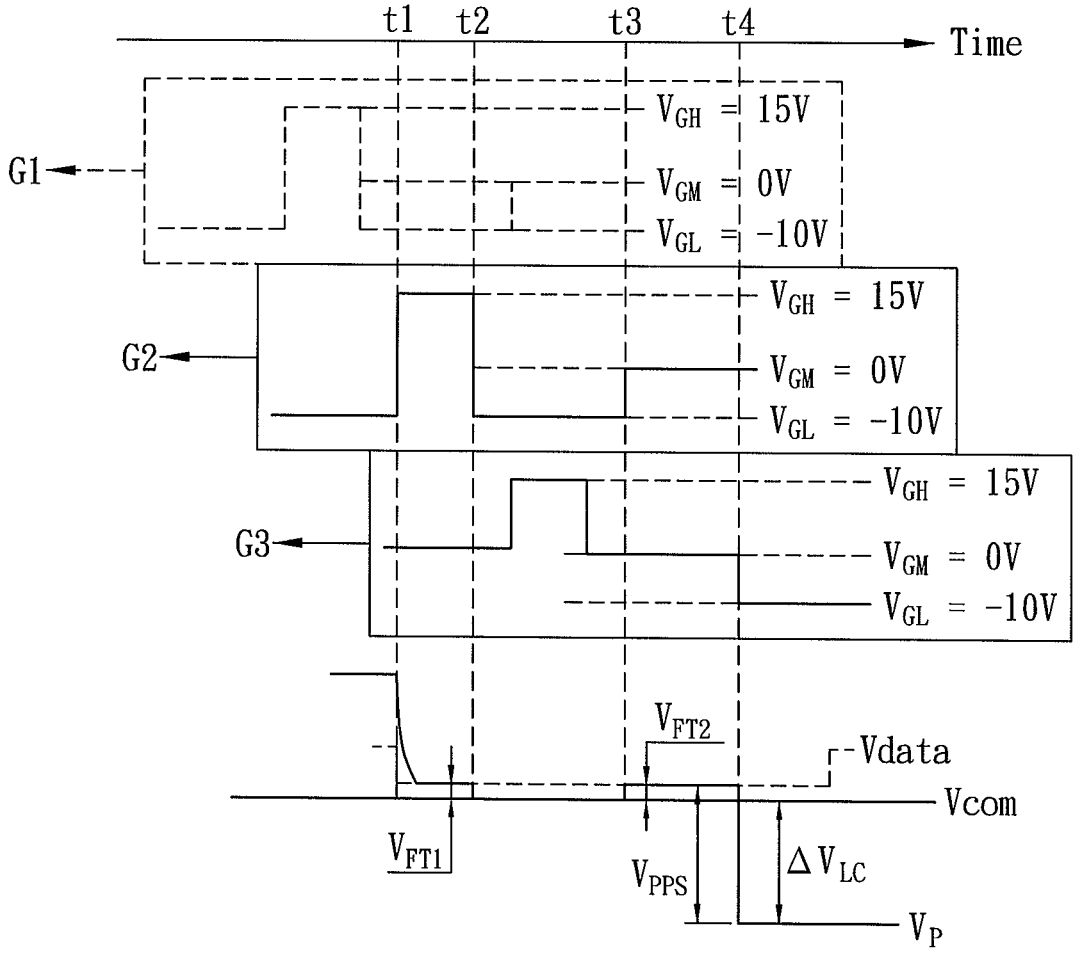

FIG. 7A is a schematic diagram of the pixel unit A in FIG. 2, and FIG. 7B is a schematic diagram of signal waveforms of the pixel P4 of the pixel unit A in FIG. 7A during the first frame time.

During the first frame time, the first scan line (scan line G2) switches to the first voltage level $V_{GH}$ from the third voltage level $V_{GL}$, then switches to the third voltage level $V_{GL}$, and then switches to the second voltage level $V_{GM}$ from the third voltage level $V_{GL}$. Meanwhile, the second scan line (scan line G3) switches to the first voltage level $V_{GH}$ from the second voltage level $V_{GM}$, then switches to the second voltage level $V_{GM}$, and then switches to the third voltage level $V_{GL}$ from the second voltage level $V_{GM}$. Accordingly, during the period from the time t1 to the time t2, since the switch element S is enabled by the first voltage level $V_{GH}$ of the first scan line (scan line G2), the voltage of the data line D3 is inputted to the pixel electrode $V_P$, so that the pixel voltage $V_P$ has the same voltage level as the data line D3 ($V_P$=Vdata). Here, the data line D3 is on the operation of negative polarity.

At the time t2, the first feedthrough effect is caused to the pixel electrode $V_P$ because the scan line G2 (first scan line) goes down to the third voltage level $V_{GL}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GL}-V_{GH})$, $V_{FT1}<0$.

At the time t3, the second feedthrough effect is caused to the pixel electrode $V_P$ because the scan line G2 (first scan line) goes up to the second voltage level $V_{GM}$ from the third voltage level $V_{GL}$. Therefore, the pixel electrode $V_P$ generates the second variation in voltage level (lift by $V_{FT2}$), and the voltage difference $V_{FT2}$ is represented by the equation: $V_{FT2}=C_{GD}/(C_{GD}+C_P+C)\times(V_{GM}-V_{GL})$, $V_{FT2}>0$.

At the time t4, the third feedthrough effect is caused to the pixel electrode $V_P$ because the scan line G3 (second scan line) goes down to the third voltage level $V_{GL}$ from the second voltage level $V_{GM}$, and meanwhile the capacitive coupling effect is caused by the coupling capacitance C. Therefore, the pixel electrode $V_P$ generates the third variation in voltage level (drop by $V_{PPS}$), and the voltage difference $V_{PPS}$ is represented by the equation: $V_{PPS}=C/(C_{GD}+C_P+C)\times(V_{GL}-V_{GM})$, $V_{PPS}<0$. Therefore, since the electrode pixel $V_P$ is in conformity with the equation: $V_P$=Vdata+$V_{FT1}$+$V_{FT2}$+$V_{PPS}$, the voltage difference $\Delta V_{LC}$ (=$V_P$−Vcom) between the pixel electrode and the common electrode is smaller than zero, so that the pixel electrode $V_P$ is negative polarity.

Figure 8A:
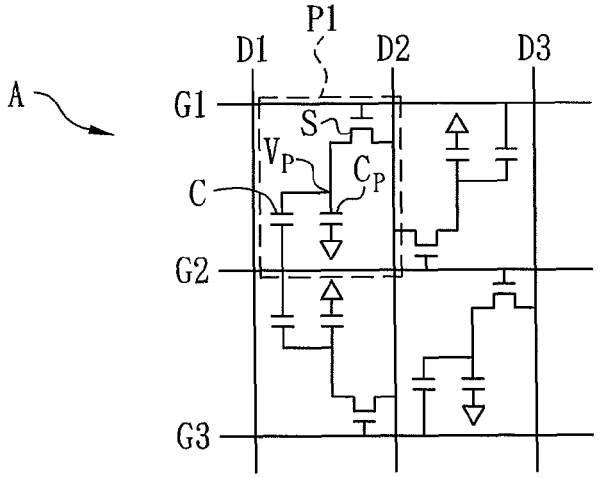
Figure 8B:
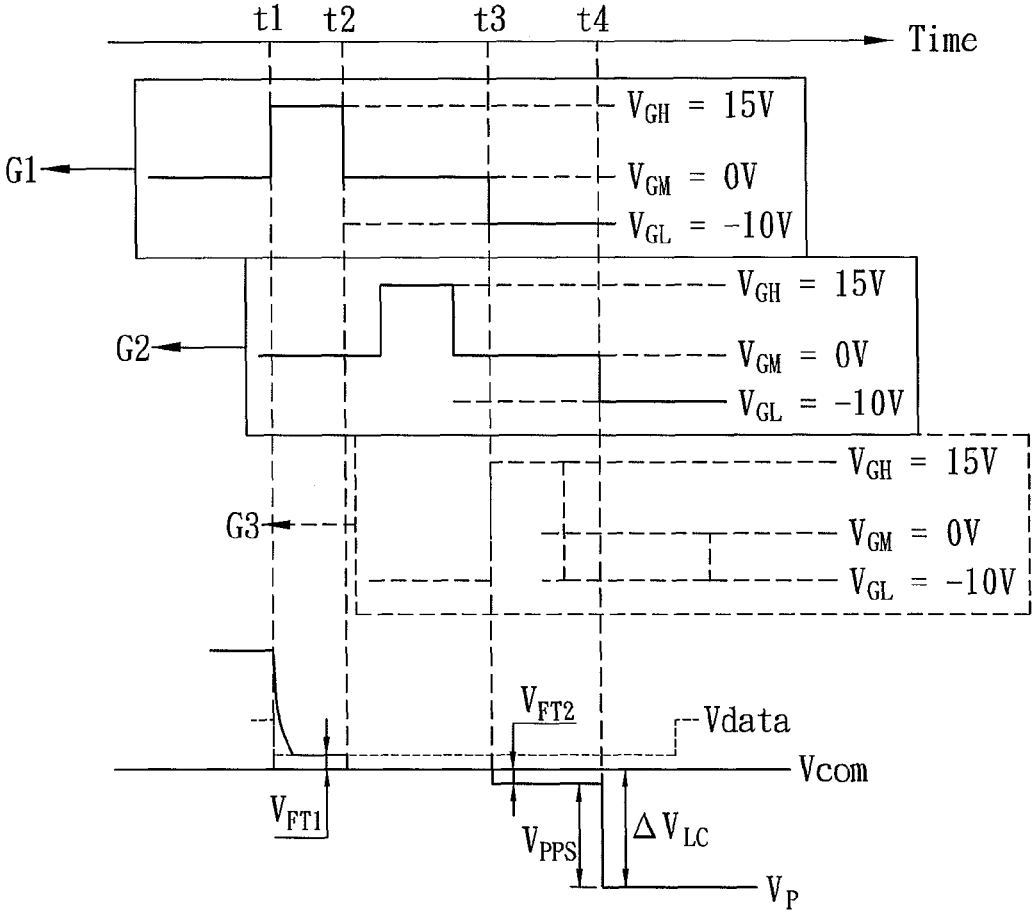

FIG. 8A is a schematic diagram of the pixel unit A in FIG. 2, and FIG. 8B is a schematic diagram of signal waveforms of the pixel P1 of the pixel unit A in FIG. 8A during the second frame time.

During the second frame time, each of the first scan line (scan line G1) and the second scan line (scan line G2) switches to the first voltage level $V_{GH}$ from the second voltage level $V_{GM}$, then switches to the second voltage level $V_{GM}$, and then switches to the third voltage level $V_{GL}$ from the second voltage level $V_{GM}$. Accordingly, during the period from the time t1 to the time t2, since the switch element S is enabled by the first voltage level $V_{GH}$ of the first scan line (scan line G1), the voltage of the data line D2 is inputted to the pixel electrode $V_P$, so that the pixel voltage $V_P$ has the same voltage level as the data line D2 ($V_P$=Vdata). Here, the data line D2 is on the operation of negative polarity.

At the time t2, the first feedthrough effect is caused to the pixel electrode $V_P$ because the scan line G1 (first scan line) goes down to the second voltage level $V_{GM}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GM}-V_{GH})$, $V_{FT1}<0$.

At the time t3, the second feedthrough effect is caused to the pixel electrode $V_P$ because the scan line G1 (first scan line) goes down to the third voltage level $V_{GL}$ from the second voltage level $V_{GM}$. Therefore, the pixel electrode $V_P$ generates the second variation in voltage level (drop by $V_{FT2}$), and the voltage difference $V_{FT2}$ is represented by the equation: $V_{FT2}=C_{GD}/(C_{GD}+C_P+C)\times(V_{GL}-V_{GM})$, $V_{FT2}<0$. To deserve to be mentioned, although the scan line G2 (second scan line) goes up to the first voltage level $V_{GH}$ from the second voltage level $V_{GM}$ and goes down to the second voltage level $V_{GM}$ from the first voltage level $V_{GH}$ during the period from the time t2 to the time t3, the total feedthrough effects (a positive and a negative) thus caused just offset each other, so that the voltage level of the pixel electrode $V_P$ will not be affected.

At the time t4, the third feedthrough effect is caused to the pixel electrode $V_P$ because the scan line G2 (second scan line) goes down to the third voltage level $V_{GL}$ from the second voltage level $V_{GM}$, and meanwhile the capacitive coupling effect is caused by the coupling capacitance C. Therefore, the pixel electrode $V_P$ generates the third variation in voltage level (drop by $V_{PPS}$), and the voltage difference $V_{PPS}$ is represented by the equation: $V_{PPS}=C/(C_{GD}+C_P+C)\times(V_{GL}-V_{GM})$, $V_{PPS}<0$. Therefore, since the electrode pixel $V_P$ is in conformity with the equation: $V_P$=Vdata+$V_{FT1}$+$V_{FT2}$+$V_{PPS}$, the voltage difference $\Delta V_{LC}$ (=$V_P$−Vcom) between the pixel electrode and the common electrode is smaller than zero, so that the pixel electrode $V_P$ is negative polarity.

Figure 9A:
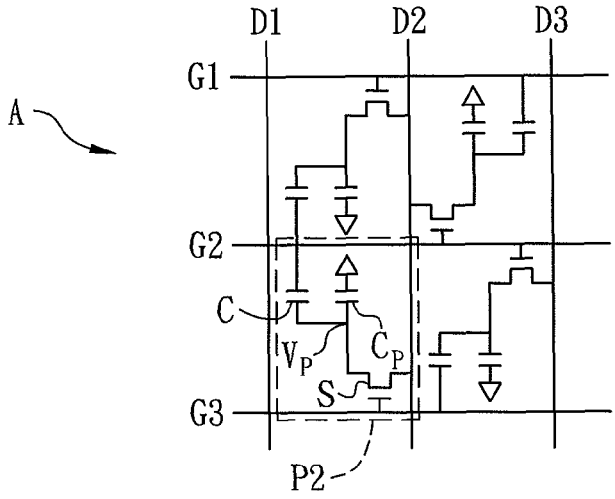
Figure 9B:
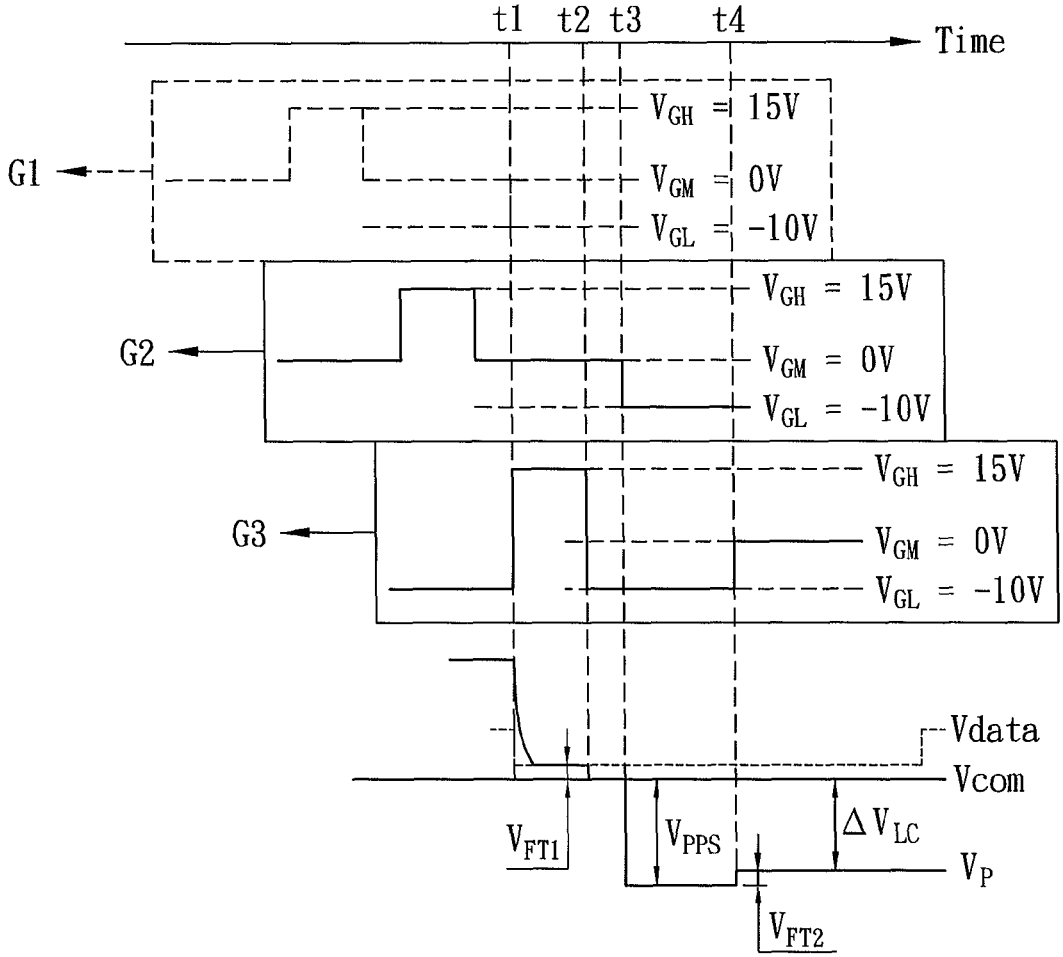

FIG. 9A is a schematic diagram of the pixel unit A in FIG. 2, and FIG. 9B is a schematic diagram of signal waveforms of the pixel P2 of the pixel unit A in FIG. 9A during the second frame time.

During the second frame time, the first scan line (scan line G3) switches to the first voltage level $V_{GH}$ from the third voltage level $V_{GL}$, then switches to the third voltage level $V_{GL}$, and then switches to the second voltage level $V_{GM}$ from the third voltage level $V_{GL}$. Meanwhile, the second scan line (scan line G2) switches to the first voltage level $V_{GH}$ from the second voltage level $V_{GM}$, then switches to the second voltage level $V_{GM}$, and then switches to the third voltage level $V_{GL}$ from the second voltage level $V_{GM}$. Accordingly, during the period from the time t1 to the time t2, since the switch element S is enabled by the first voltage level $V_{GH}$ of the first scan line (scan line G3), the voltage of the data line D2 is inputted to the pixel electrode $V_P$, so that the pixel voltage $V_P$ has the same voltage level as the data line D2 ($V_P$=Vdata). Here, the data line D2 is on the operation of negative polarity.

At the time t2, the first feedthrough effect is caused to the pixel electrode $V_P$ because the scan line G3 (first scan line) goes down to the third voltage level $V_{GL}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GL}-V_{GH})$, $V_{FT1}<0$.

At the time t3, the second feedthrough effect is caused to the pixel electrode $V_P$ because the scan line G2 (second scan line) goes down to the third voltage level $V_{GL}$ from the second voltage level $V_{GM}$, and meanwhile the capacitive coupling effect is caused by the coupling capacitance C. Therefore, the pixel electrode $V_P$ generates the second variation in voltage level (drop by $V_{PPS}$), and the voltage difference $V_{PPS}$ is represented by the equation: $V_{PPS}=C/(C_{GD}+C_P+C)\times(V_{GL}-V_{GM})$, $V_{PPS}<0$.

At the time t4, the third feedthrough effect is caused to the pixel electrode $V_P$ because the scan line G3 (first scan line) goes up to the second voltage level $V_{GM}$ from the third voltage level $V_{GL}$. Therefore, the pixel electrode $V_P$ generates the third variation in voltage level (lift by $V_{FT2}$), and the voltage difference $V_{FT2}$ is represented by the equation: $V_{FT2}=C_{GD}/(C_{GD}+C_P+C)\times(V_{GM}-V_{GL})$, $V_{FT2}>0$ . Therefore, since the electrode pixel $V_P$ is in conformity with the equation: $V_P$=Vdata+$V_{FT1}$+$V_{PPS}$+$V_{FT2}$, the voltage difference $\Delta V_{LC}$ (=$V_P$−Vcom) between the pixel electrode and the common electrode is smaller than zero, so that the pixel electrode $V_P$ is negative polarity.

Figure 10A:
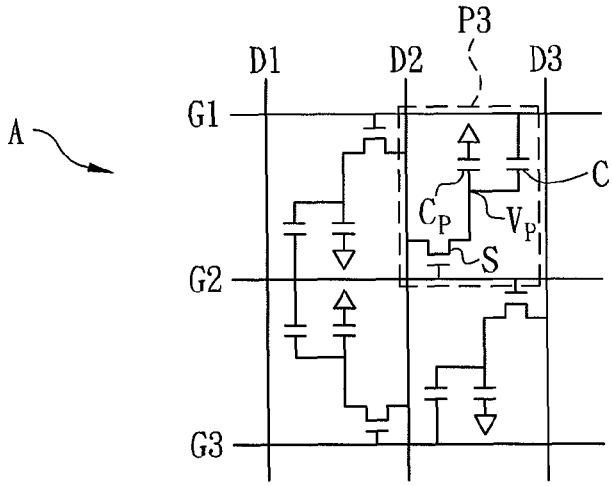
Figure 10B:
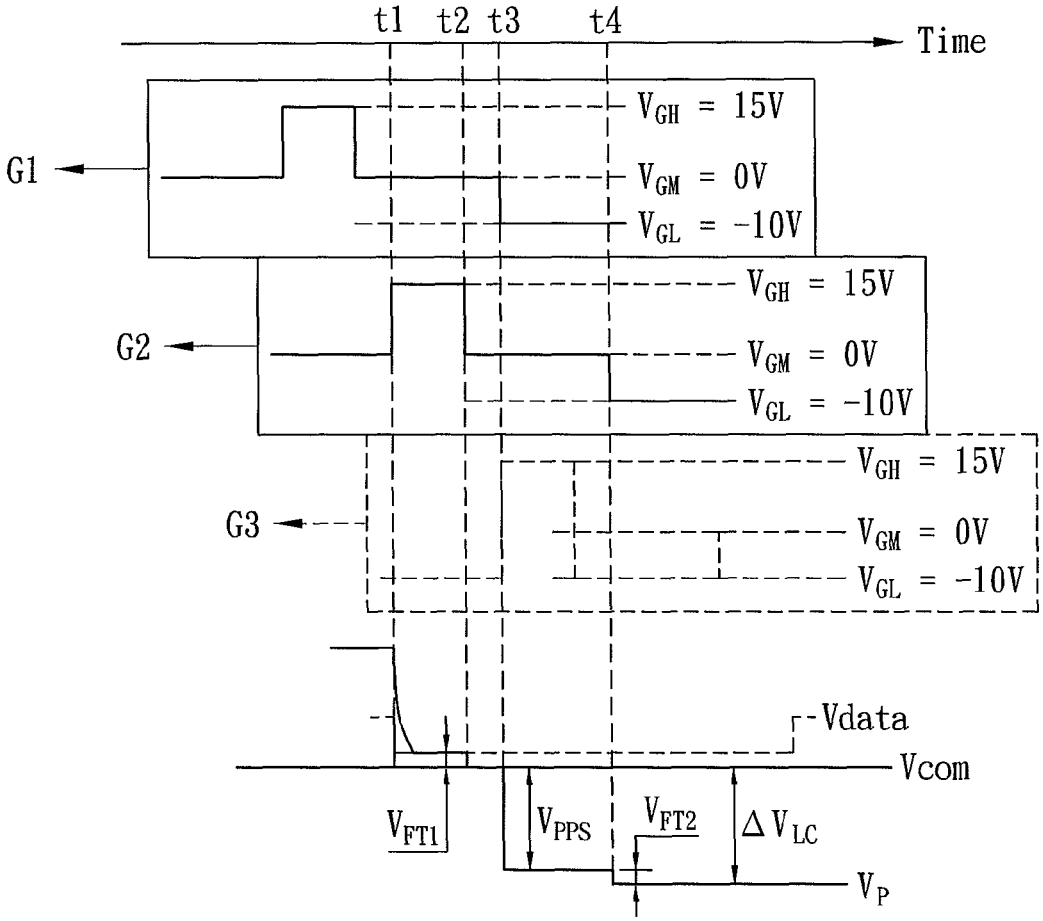

FIG. 10A is a schematic diagram of the pixel unit A in FIG. 2, and FIG. 10B is a schematic diagram of signal waveforms of the pixel P3 of the pixel unit A in FIG. 10A during the second frame time.

During the second frame time, each of the first scan line (scan line G2) and the second scan line (scan line G1) switches to the first voltage level $V_{GH}$ from the second voltage level $V_{GM}$, then switches to the second voltage level $V_{GM}$, and then switches to the third voltage level $V_{GL}$ from the second voltage level $V_{GM}$. Accordingly, during the period from the time t1 to the time t2, since the switch element S is enabled by the first voltage level $V_{GH}$ of the first scan line (scan line G2), the voltage of the data line D2 is inputted to the pixel electrode $V_P$, so that the pixel voltage $V_P$ has the same voltage level as the data line D2 ($V_P$=Vdata). Here, the data line D2 is on the operation of negative polarity.

At the time t2, the first feedthrough effect is caused to the pixel electrode $V_P$ because the scan line G2 (first scan line) goes down to the second voltage level $V_{GM}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GM}-V_{GH})$, $V_{FT1}<0$.

At the time t3, the second feedthrough effect is caused to the pixel electrode $V_P$ because the scan line G1 (second scan line) goes down to the third voltage level $V_{GL}$ from the second voltage level $V_{GM}$, and meanwhile the capacitive coupling effect is caused by the coupling capacitance C. Therefore, the pixel electrode $V_P$ generates the second variation in voltage level (drop by $V_{PPS}$), and the voltage difference $V_{PPS}$ is represented by the equation: $V_{PPS}=C/(C_{GD}+C_P+C)\times(V_{GL}-V_{GM})$, $V_{PPS}<0$.

At the time t4, the third feedthrough effect is caused to the pixel electrode $V_P$ because the scan line G2 (first scan line) goes down to the third voltage level $V_{GL}$ from the second voltage level $V_{GM}$. Therefore, the pixel electrode $V_P$ generates the third variation in voltage level (drop by $V_{FT2}$), and the voltage difference $V_{FT2}$ is represented by the equation: $V_{FT2}=C_{GD}/(C_{GD}+C_P+C)\times(V_{GL}-V_{GM})$, $V_{FT2}<0$. Therefore, since the electrode pixel $V_P$ is in conformity with the equation: $V_P$=Vdata+$V_{FT1}$+$V_{PPS}$+$V_{FT2}$, the voltage difference $\Delta V_{LC}$ (=$V_P$−Vcom) between the pixel electrode and the common electrode is smaller than zero, so that the pixel electrode $V_P$ is negative polarity.

Figure 11A:
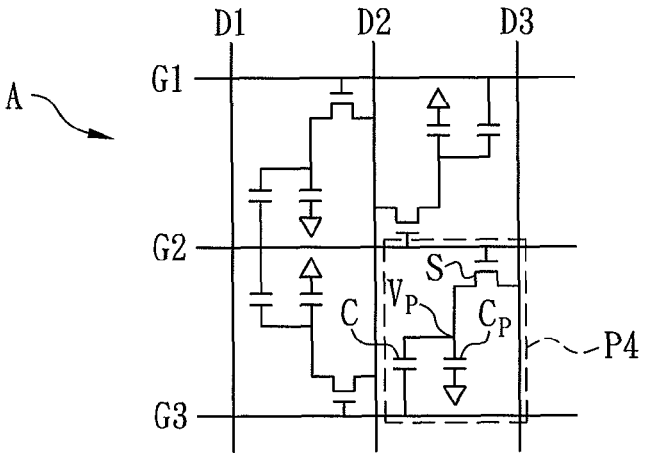
Figure 11B:
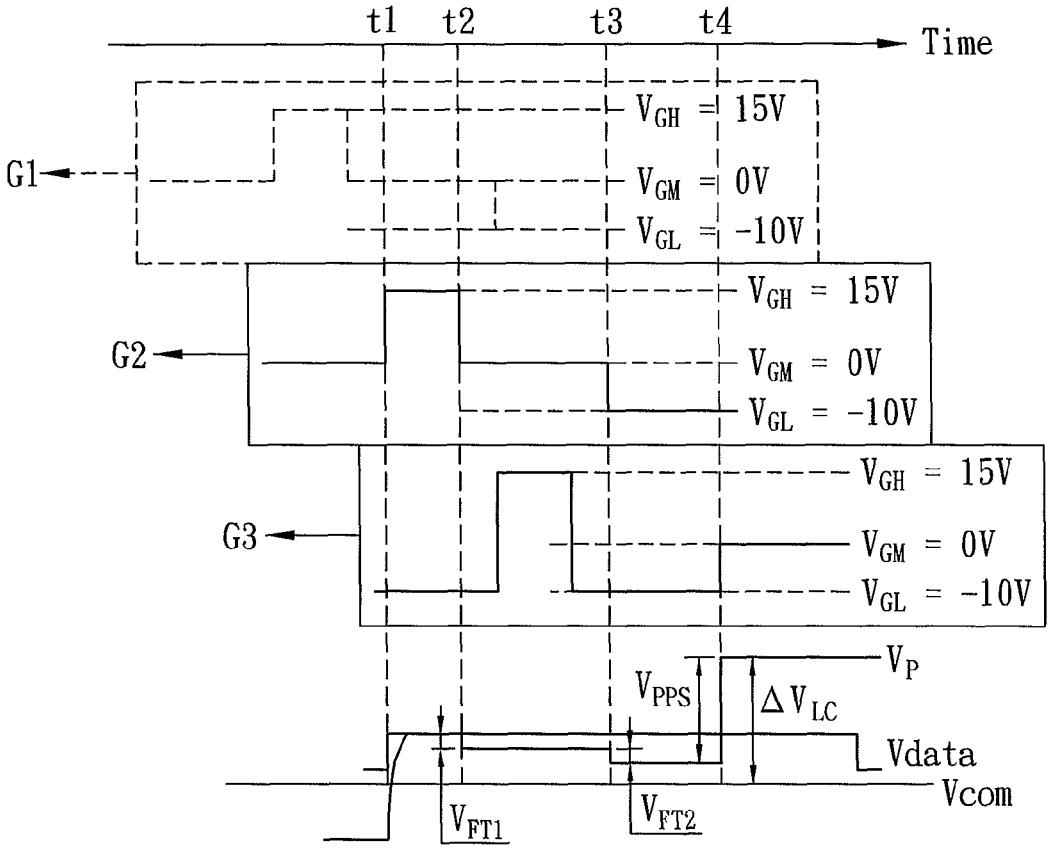

FIG. 11A is a schematic diagram of the pixel unit A in FIG. 2, and FIG. 11B is a schematic diagram of signal waveforms of the pixel P4 of the pixel unit A in FIG. 11A during the second frame time.

During the second frame time, the first scan line (scan line G2) switches to the first voltage level $V_{GH}$ from the second voltage level $V_{GM}$, then switches to the second voltage level $V_{GM}$, and then switches to the third voltage level $V_{GL}$ from the second voltage level $V_{GM}$. Meanwhile, the second scan line (scan line G3) switches to the first voltage level $V_{GH}$ from the third voltage level $V_{GL}$, then switches to the third voltage level $V_{GL}$, and then switches to the second voltage level $V_{GM}$ from the third voltage level $V_{GL}$. Accordingly, during the period from the time t1 to the time t2, since the switch element S is enabled by the first voltage level $V_{GH}$ of the first scan line (scan line G2), the voltage of the data line D3 is inputted to the pixel electrode $V_P$, so that the pixel voltage $V_P$ has the same voltage level as the data line D3 ($V_P$=Vdata). Here, the data line D3 is on the operation of positive polarity.

At the time t2, the first feedthrough effect is caused to the pixel electrode $V_P$ because the scan line G2 (first scan line) goes down to the second voltage level $V_{GM}$ from the first voltage level $V_{GH}$. Therefore, the pixel electrode $V_P$ generates the first variation in voltage level (drop by $V_{FT1}$), and the voltage difference $V_{FT1}$ is represented by the equation: $V_{FT1}=C_{GD}/(C_{GD}+C_P+C)\times(V_{GM}-V_{GH})$, $V_{FT1}<0$.

At the time t3, the second feedthrough effect is caused to the pixel electrode $V_P$ because the scan line G2 (first scan line) goes down to the third voltage level $V_{GL}$ from the second voltage level $V_{GM}$. Therefore, the pixel electrode $V_P$ generates the second variation in voltage level (drop by $V_{FT2}$), and the voltage difference $V_{FT2}$ is represented by the equation: $V_{FT2}=C_{GD}/(C_{GD}+C_P+C)\times(V_{GL}-V_{GM})$, $V_{FT2}<0$. To deserve to be mentioned, although the scan line G3 (second scan line) goes up to the first voltage level $V_{GH}$ from the third voltage level $V_{GL}$ and goes down to the third voltage level $V_{GL}$ from the first voltage level $V_{GH}$ during the period from the time t2 to the time t3, the total feedthrough effects (a positive and a negative) thus caused just offset each other, so that the voltage level of the pixel electrode $V_P$ will not be affected.

At the time t4, the third feedthrough effect is caused to the pixel electrode $V_P$ because the scan line G3 (second scan line) goes up to the second voltage level $V_{GM}$ from the third voltage level $V_{GL}$, and meanwhile the capacitive coupling effect is caused by the coupling capacitance C. Therefore, the pixel electrode $V_P$ generates the third variation in voltage level (lift by $V_{PPS}$), and the voltage difference $V_{PPS}$ is represented by the equation: $V_{PPS}=C/(C_{GD}+C_P+C)\times(V_{GM}-V_{GL})$, $V_{PPS}>0$. Therefore, since the electrode pixel $V_P$ is in conformity with the equation: $V_P$=Vdata+$V_{FT1}$+$V_{FT2}$+$V_{PPS}$, the voltage difference $\Delta V_{LC}$ (=$V_P$−Vcom) between the pixel electrode and the common electrode is larger than zero, so that the pixel electrode $V_P$ is positive polarity.

In conclusion, in the all above-mentioned driving processes of the pixel, the capacitive coupling effect generated by the gate-drain parasitic capacitance of the switch element S can be caused twice to obtain $V_{FT1}$ and $V_{FT2}$. Besides, the capacitive coupling effect is caused once by the coupling capacitance C to obtain $V_{PPS}$. The amount of the coupling capacitance C can be designed according to the requirements of images displayed by the pixels of the display panel 11.

Furthermore, in the LCD apparatus 1 according to the embodiments of this disclosure, the scan signal have three different voltage levels as mentioned above to drive the pixels, so that the voltage difference of the positive and negative polarities of the pixel electrode is larger than that of the data signal, and only the less swing of the operating voltages of the data line is needed (supposing the difference between the highest and lowest voltages of the data line in the conventional art is 10V, that of the data line of this disclosure is just 5V for example) to make the pixel have larger voltage levels of positive and negative polarities which are required for the pixel's operation. Therefore, in this disclosure, the swing of the operating voltages of positive and negative polarities of the data line can be reduced for decreasing the power consumption of the data driving circuit and thus achieving the power saving.

FIGS. 12A and 12B are schematic diagrams respectively showing the polarity inversions of the pixel of the LCD apparatus 1 during the first and second frame times according to an embodiment of this disclosure.

The data driving circuit 123 of the LCD apparatus 1 of the embodiments of this disclosure outputs signals in the column inversion mode, wherein the polarity inversion of the pixel during the first frame time is shown by FIG. 12A, and the polarity inversion of the pixel during the second frame time is shown by FIG. 12B, and this kind of mode as shown in FIGS. 12A and 12B is called 2-Dot shift inversion mode. The 2-Dot shift inversion mode can make better image quality for the display apparatus, and therefore, the LCD apparatus 1 can satisfy the requirements of high resolution panels, such as smart phones, tablet computers, PDAs, digital cameras, notebooks or other portable electronic apparatuses. Besides, compared with the conventional art, only one data line and one scan line are additional for the LCD apparatus 1, so that the aperture ratio will not be reduced.

Figure 13:
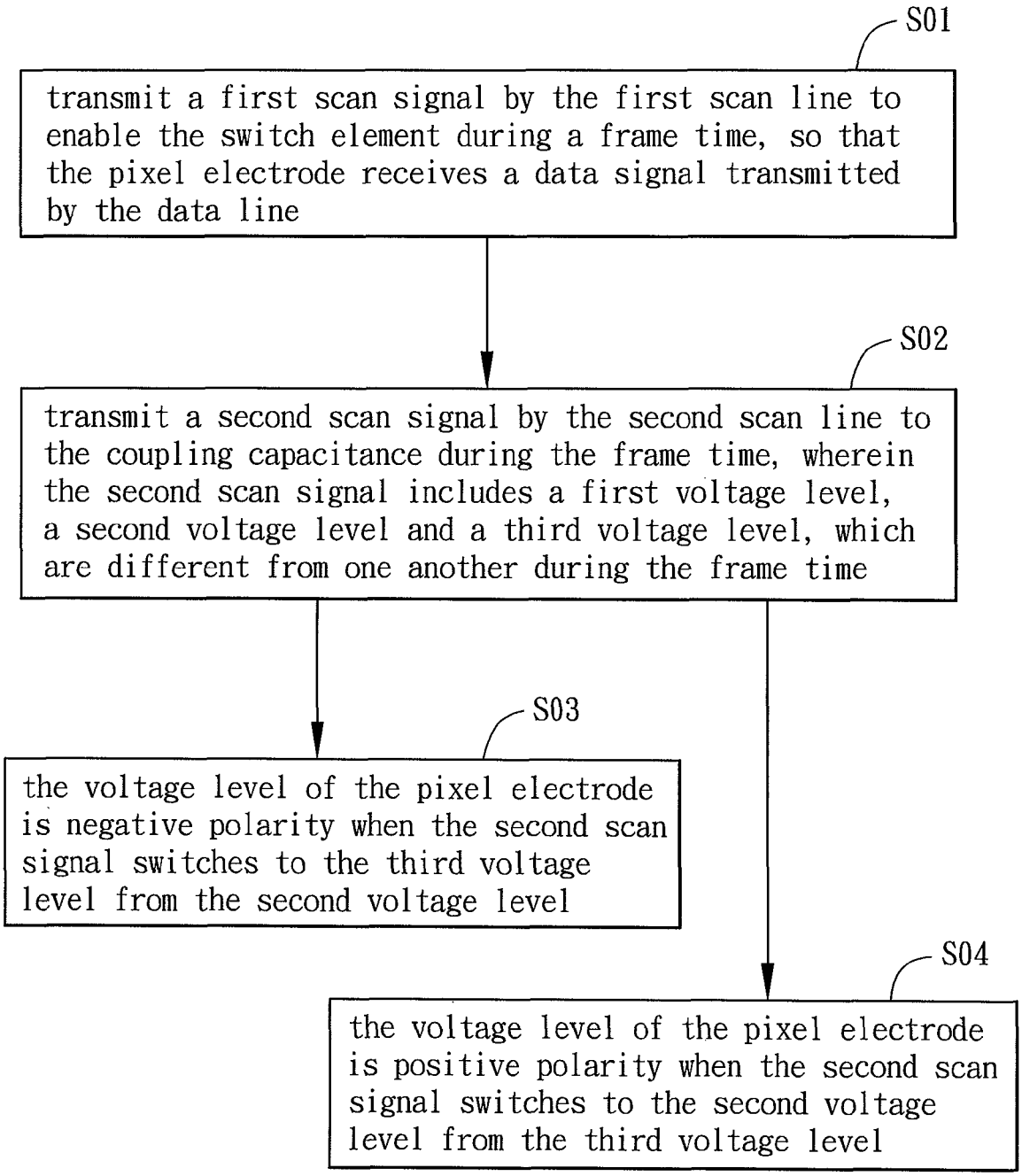
FIG. 13 is a flow chart of a driving method of an LCD apparatus according to an embodiment of this disclosure.

FIG. 13 is a flow chart of a driving method of an LCD apparatus 1 according to an embodiment of this disclosure.

The LCD apparatus includes a plurality of pixels, each of which has a first scan line, a second scan line, a data line, a switch element and a pixel electrode. The data line intersects the first and second scan lines. The switch element is electrically coupled to the first scan line and the data line. The pixel electrode is electrically coupled to the switch element. The coupling capacitance is electrically coupled to the pixel electrode and the second scan line.

In FIG. 13, the driving method of the LCD apparatus 1 includes the steps S01 to S04.

The step S01 is to transmit a first scan signal by the first scan line to enable (turn on) the switch element during a frame time, so that the pixel electrode receives a data signal transmitted by the data line. In this embodiment, the first scan signal has three different voltage levels, i.e. a first voltage level, a second voltage level and a third voltage level, during the frame time. During the frame time, the first scan line switches to the third voltage level from the first voltage level and then switches to the second voltage level, or switches to the second voltage level from the first voltage level and then switches to the third voltage level. When the voltage level of the first scan signal changes, the voltage level of the pixel electrode is changed by the capacitive coupling effect generated by a parasitic capacitance of the switch element. Besides, the switch element is turned on by the first voltage level of the first scan line, and turned off by the second voltage level or the third voltage level of the first scan line.

The step S02 is to transmit a second scan signal by the second scan line to the coupling capacitance during the frame time, wherein the second scan signal includes a first voltage level, a second voltage level and a third voltage level during the frame time. During the frame time, the second scan line switches to the third voltage level from the first voltage level and then switches to the second voltage level, or switches to the second voltage level from the first voltage level and then switches to the third voltage level. The first voltage level of the first and second scan signals is higher than the second voltage level which is higher than the third voltage level. To be noted, the step S01 and the step S02 can be reversed in order.

The step S03 is that the voltage level of the pixel electrode is negative polarity when the second scan signal switches to the third voltage level from the second voltage level.

The step S04 is that the voltage level of the pixel electrode is positive polarity when the second scan signal switches to the second voltage level from the third voltage level. When the voltage level of the second scan signal changes, the voltage level of the pixel electrode is changed by the capacitive coupling effect that is generated by the coupling capacitance. Besides, the voltage difference between the positive and negative polarities of the pixel electrode is larger than that of the data signal.

Other technical features of the driving method of the LCD apparatus 1 have been illustrated clearly in the all above embodiments, and therefore they are not described here for concise purpose.

In summary, in the LCD apparatus according to the embodiments of this disclosure, the scan signal have three different voltage levels to drive the pixels, so that only the less swing of the operating voltages of the data line is needed to make the pixel have larger voltage levels of positive and negative polarities which are required for the pixel's operation. Therefore, in this disclosure, the swing of the operating voltages of positive and negative polarities of the data line can be reduced, so that the power consumption of the data driving circuit is decreased and thus the power saving is achieved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A liquid crystal display apparatus having at least one pixel, the pixel comprising:

a first scan line transmitting a first scan signal;

a second scan line transmitting a second scan signal, wherein the second scan signal has a first voltage level, a second voltage level and a third voltage level, which are different from one another during a frame time;

a data line intersecting the first and second scan lines;

a switch element electrically coupled to the first scan line and the data line;

a pixel electrode electrically coupled to the switch element, wherein when the first scan line enables the switch element, the pixel electrode receives a data signal through the data line; and a coupling capacitance electrically coupled to the pixel electrode and the second scan line, wherein when the second scan signal switches to the third voltage level from the second voltage level, the pixel electrode is negative polarity, and when the second scan signal switches to the second voltage level from the third voltage level, the pixel electrode is positive polarity, wherein the first scan signal has a first voltage level, a second voltage level and a third voltage level, which are different from one another during a frame time, and the first voltage level is higher than the second voltage level, and the second voltage level is higher than the third voltage level.

2. The liquid crystal display apparatus as recited in claim 1, wherein during the frame time, the first scan line switches to the third voltage level from the first voltage level and then switches to the second voltage level, or switches to the second voltage level from the first voltage level and then switches to the third voltage level.

3. The liquid crystal display apparatus as recited in claim 1, wherein during the frame time, the second scan line switches to the third voltage level from the first voltage level and then switches to the second voltage level, or switches to the second voltage level from the first voltage level and then switches to the third voltage level.

4. The liquid crystal display apparatus as recited in claim 1, wherein when the voltage level of the first scan signal changes, the voltage level of the pixel electrode is changed by the capacitive coupling effect generated by a parasitic capacitance of the switch element.

5. The liquid crystal display apparatus as recited in claim 1, wherein when the voltage level of the second scan signal changes, the voltage level of the pixel electrode is changed by the capacitive coupling effect generated by a parasitic capacitance of the switch element.

6. The liquid crystal display apparatus as recited in claim 1, wherein the switch element includes a metal oxide thin film transistor.

7. The liquid crystal display apparatus as recited in claim 1, wherein the first voltage level of the first scan line enables the switch element, and the second and third voltage levels of the first scan line each disable the switch element.

8. A driving method of a liquid crystal display apparatus which includes at least one pixel having a first scan line, a second scan line, a data line, a switch element and a pixel electrode, wherein the data line intersects the first and second scan lines, the switch element is electrically coupled to the first scan line and the data line, the pixel electrode is electrically coupled to the switch element, and a coupling capacitance is electrically coupled to the pixel electrode and the second scan line, the driving method comprising:

transmitting a first scan signal by the first scan line to enable he switch element during a frame time, so that the pixel electrode receives a data signal transmitted by the data line;

transmitting a second scan signal by the second scan line to the coupling capacitance during the frame time, wherein the second scan signal includes a first voltage level, a second voltage level and a third voltage level, which are different from one another during the frame time;

the voltage level of the pixel electrode being negative polarity when the second scan signal switches to the third voltage level from the second voltage level; and the voltage level of the pixel electrode being positive polarity when the second scan signal switches to the second voltage level from the third voltage level, wherein the first scan signal has a first voltage level a second voltage level and a third voltage level, which are different from one another during the frame time, and the first voltage level is higher than the second voltage level, and the second voltage level is higher than the third voltage level.

9. The driving method as recited in claim 8, wherein during the frame time, the first scan line switches to the third voltage level from the first voltage level and then switches to the second voltage level, or switches to the second voltage level from the first voltage level and then switches to the third voltage level.

10. The driving method as recited in claim 8, wherein during the frame time, the second scan line switches to the third voltage level from the first voltage level and then switches to the second voltage level, or switches to the second voltage level from the first voltage level and then switches to the third voltage level.

* * * * *